United States Patent [19]

Reed

[11] Patent Number: 4,622,762

[45] Date of Patent: Nov. 18, 1986

[54] THROUGHFLOW TREATMENT CONTROL

[75] Inventor: Colin M. Reed, Manchester, England

[73] Assignee: National Research Development Corp., London, England

[21] Appl. No.: 707,868

[22] Filed: Mar. 4, 1985

[30] Foreign Application Priority Data

Mar. 5, 1984 [GB] United Kingdom ..... 8405716

[51] Int. Cl.[4] ..... F26B 13/02

[52] U.S. Cl. ..... 34/155; 34/242; 432/242

[58] Field of Search ..... 34/155, 242, 34, 54, 34/48; 432/242

[56] References Cited

U.S. PATENT DOCUMENTS 4,354,686 10/1982 Imanishi et al. ..... 34/242

*Primary Examiner*—Larry I. Schwartz

*Attorney, Agent, or Firm*—Cushman, Darby & Cushman

[57] ABSTRACT

A process in which material (20) is passed effectively continuously through a gaseous treatment chamber (10) by way of at least one open port (12) is improved by applying gas curtains across the material path to form externally adjacent the port a buffer zone (50) between the chamber interior and the surrounding atmosphere, which zone acts generally to balance the gaseous outflow otherwise occurring through the port. The buffer zone is preferably formed by and between two curtains serially spaced nearer to and further from the port, the curtains being respectively formed with gas drawn from without and within the zone. The zone is suitably sustained in varying conditions by control of curtain flow rate in response to a zone parameter such as temperature.

11 Claims, 2 Drawing Figures

THROUGHFLOW TREATMENT CONTROL

Figure 1:
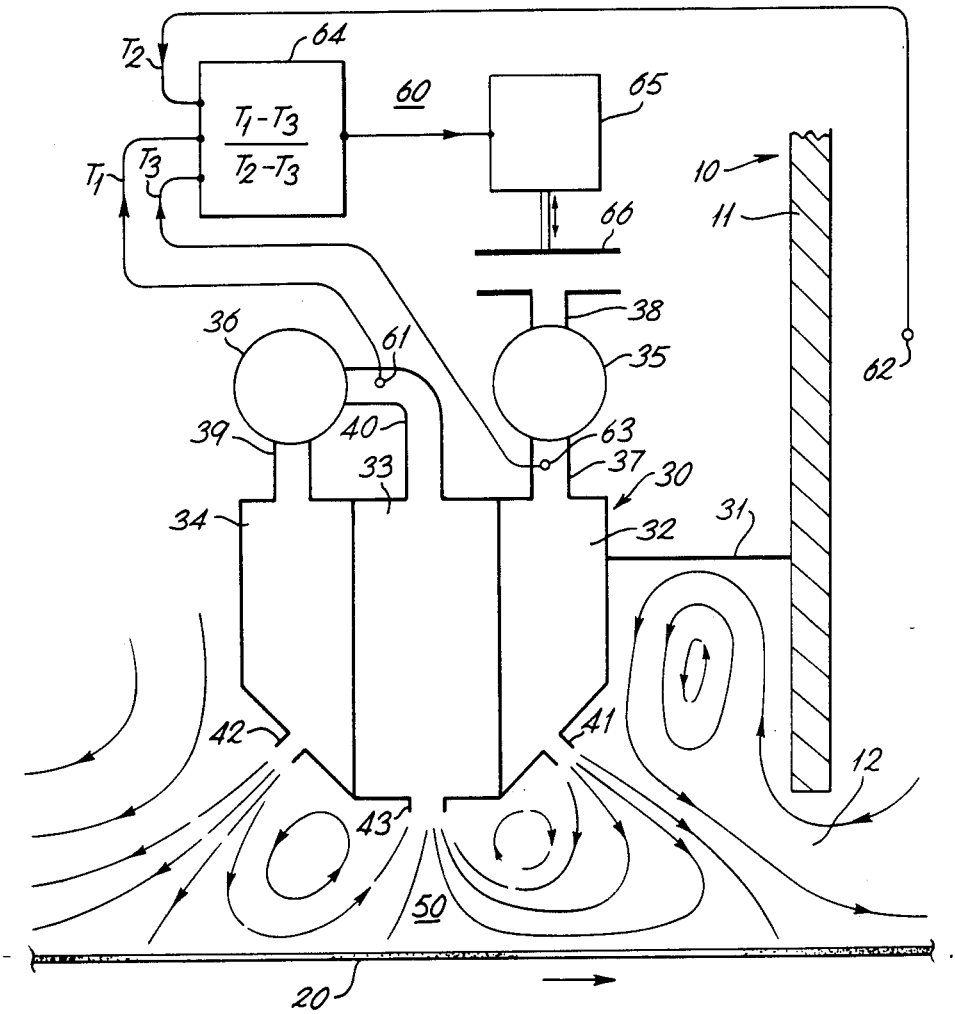

This invention concerns throughflow treatments of the kind involving a gaseous treatment chamber having inlet and outlet ports which remain open during use to allow effectively continuous passage through the chamber of material to be treated. A treatment of this kind will normally involve continuous passage through the chamber of material of elongated form but an alternative possibility can involve effectively continuous passage of a series of relatively short discrete articles through the chamber by way of a conveyor system.

The invention is concerned more particularly with the control of such a treatment by containment at the ports of the atmosphere within the chamber to effect improved thermal efficiency and/or to reduce undesirable contamination of the surrounding atmosphere.

The invention has in fact been conceived and developed in relation to so-called stenters and it is convenient to discuss the invention further with special reference to this application. However, it will be appreciated that other beneficial applications of the invention are clearly possible in the light of the further discussion.

A stenter is a special-purpose oven primarily used for drying long lengths of textile fabric after an operation, such as dyeing, which leaves the fabric wet. The drying process in a stenter is commonly of hot air, dynamic throughflow form, with air being drawn from the atmosphere, heated, blown over the fabric, circulated within the oven, and vented through an exhaust back to atmosphere. Passage of fabric through a stenter is commonly through opposed slot-form ports by the use of chain-driven gripping mechanisms along each side of the fabric, which mechanisms extend both through the oven and beyond each slot, and which are also adjustable in respect of fabric width both through and beyond the oven.

Two particular difficulties can arise with stenter operations and both of these difficulties are addressed by the present invention.

Firstly, a stenter operation is energy-intensive and energy costs are now such as to render significant the thermal efficiency of the overall operation. Accordingly some consideration is now seen to have been given to measures whereby thermal efficiency is improved.

Some obvious measures can be readily applied on the basis of existing technology. For example, the oven casing can be insulated to reduce heat losses by radiation and convection. Also, heat exchange arrangements can be used to recover heat otherwise lost by way of the oven exhaust and to use this to preheat ingoing air.

It has, in the same connection, been proposed that the process efficiency itself be improved by automatic exhaust damper control in response to a parameter such as temperature or humidity within the oven.

However, there appears to be no practicable proposal involving heat exchange recovery or other technique for an improvement which reduces the heat losses by escape of air from the ports. This is a serious omission not only because these losses can be significant, but also because any attempt to effect improved process control in the oven will be compromised by lack of control at the ports.

The second difficulty arises from the fact that some stenter operations cause the release of gaseous material which can undesirably contaminate the working environment of the stenter operators. Such contamination emerges from the ports and it is common practice to seek alleviation by operating the stenter at excessive exhaust flow rates. Clearly this practice contradicts any attempt to improve the process control and/or effect energy conservation.

A common factor in these difficulties is lack of control over escape of air and other gases from the ports, and the present invention seeks to improve this situation.

According to the present ivnention a process, which comprises passing material in an effectively continuous manner through a gaseous treatment chamber by way of at least one open port, is improved by applying gas curtains across the path of the material to form externally adjacent said port a buffer zone between the chamber interior and the surrounding atmosphere, which zone acts generally to balance the gaseous outflow otherwise occurring through said port during operation.

The curtains will normally be formed with air drawn from the surrounding atmosphere, but use can be made of air and/or gaseous material from within the stenter or from any other suitable source.

It is useful to note that the invention results from development which first involved investigation of the possibility of balancing the outflow from a stenter port with a single curtain, but this was found to be problematical. Difficulty arose particularly because of outflow pressure variations along the length of the slot formation of the port, which variations would require undue complexity in attaining a uniform result in terms of the desired balance. The subsequent concept forming the basis of the present invention is seen to resolve this difficulty because the buffer zone acts to contain localised variations in conditions at the port.

In the presently preferred form of the invention the buffer zone is formed by and between two curtains serially spaced respectively nearer to and further from the relevant port, with the latter curtain being generated with gas drawn from the buffer zone itself. The overall flow pattern is accordingly of a recirculatory form: the nearer curtain largely balances the port outflow and so is deflected into the buffer zone whence gas is drawn to form the further curtain, the latter partially replenishing the buffer zone and at the same time being partially lost to atmosphere in effective exhange for continuing addition of gas to the system by way of the nearer curtain.

Clearly it is desirable that the proposed apparatus have a control facility to sustain the above overall flow pattern notwithstanding changes in conditions from one operation to another with a given chamber and, to this end, it will normally be appropriate to apply the curtains in an adjustable manner. Moreover, it is preferred that this facility should be of an automatic dynamically operable form to take account of the fact that the conditions can vary within a single operation, such as by the effect of a stenter exhaust damper control as mentioned above.

On the basis of the development of the invention to date it is preferrred that the overall flow pattern be subject to control by way of the flow rate in at least one of the curtains and that such control be responsive to the value of a parameter of the buffer zone relative to the corresponding values of that parameter in the oven and the surrounding atmosphere. Clearly one useful parameter is that of temperature, but others can be employed such as the concentration of a specific contaminant.

Figure 2:
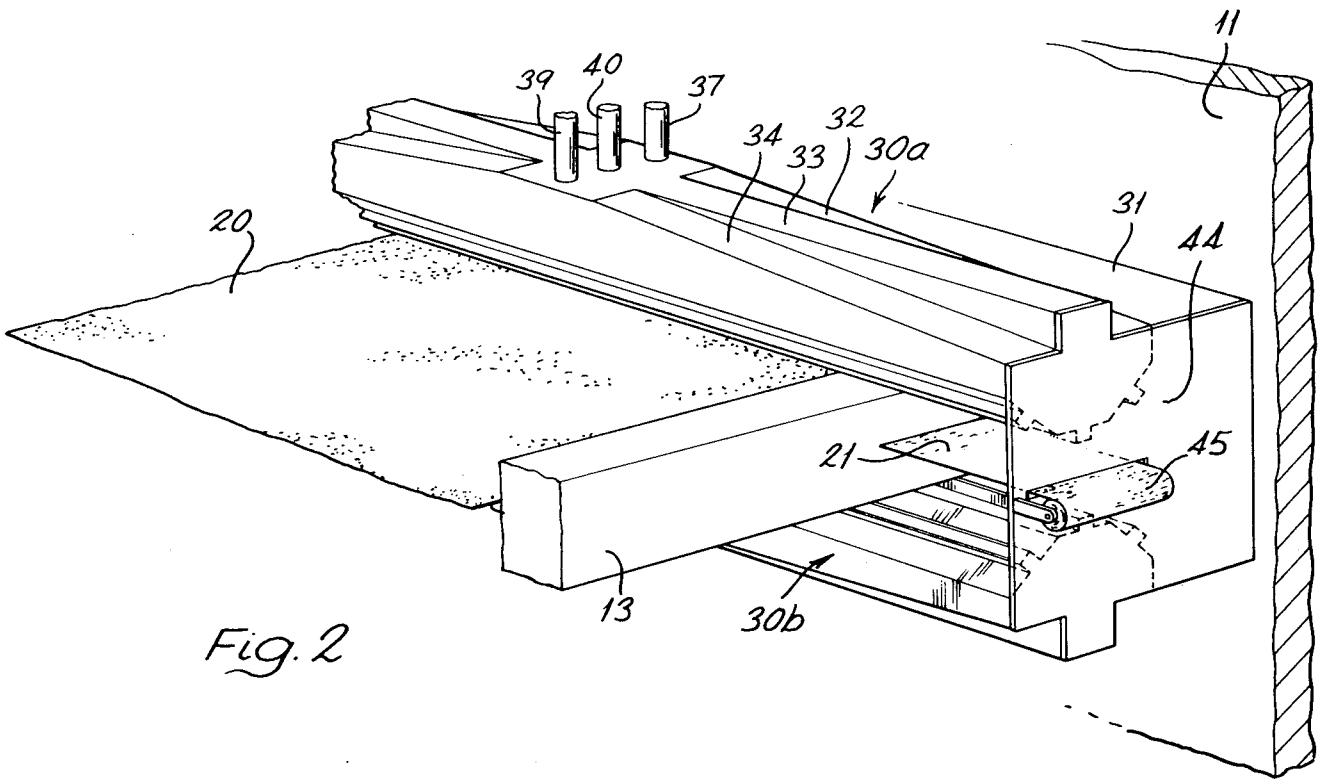

In order that the invention as so far described and other features thereof may be more clearly understood, the same will now be described by way of example with reference to the accompanying drawings, in which:

FIG. 1 partially illustrates in schematic cross-section a stenter modified to accord with the invention; and FIG. 2 partially illustrates in a perspective view the same stenter.

The illustrated stenter is denoted generally at 10 but is shown only by way of one end wall 11 of its oven on one side of a length of fabric 20 passing through the slot-form port 12 in that wall.

An air curtain applying means according to the invention and associated with the illustrated part of port 12 is denoted generally as 30 of which a part 30*a* is shown in FIG. 1, but it is to be understood that a further part 30*b* will be associated in reflected manner with the remainder of the port on the other side of the fabric, as shown in FIG. 2, this further part being of like form and operation.

Turning to the illustrated detail of part 30*a* of the means 30, this involves a screen structure 31 located to extend across the wall 11 alongside and outwardly from the port 12. Incorporated with and depending from the screen 31 are three plenum chambers extending, at an intial spacing, serially outwardly from the wall 11. The nearest, intermediate and furthest of these chambers relative to the stenter are respectively denoted 32, 33 and 34. Each of the chambers extends transversely of the wall similarly to the screen.

Two fans 35 and 36 located outside the screen are communicated with the plenum chambers by way of conduits. Fan 35 has an outlet conduit 37 connected with the chamber 32, and an inlet conduit open remotely from the fan to the atmosphere outside the screen and stenter. Fan 36 has outlet and inlet conduits 39 and 40 respectivley connected with the chambers 34 and 33.

The nearer gas curtain referred to earlier in discussion of the operation of the invention is generated with air from plenum chamber 32 by way of a slot opening extending across its underside and parallel to the port 12. This opening is preferably defined by an outwardly projecting nozzle 41 to avoid any difficulty with fluidic attachment of the curtain to nearby surfaces. Also, the opening is preferably arranged to generate a curtain directed in an inclined manner towards the stenter port and adjacent fabric path, optimally at about 45°, and this is attained by suitably inclining the underside of the chamber 32. Moreover, it is preferred that the chamber be of cross-sectional form which tapers away from its inlet conduit connection in the longitudinal direction of its opening, while the opening itself is uniform in cross-section, to compensate for the variation which otherwise occurs in the air flow rate along the curtain.

The further gas curtain referred to earlier is generated in similar manner with air from plenum chamber 34 by way of a projecting nozzle 42. This curtain is also preferably directed in an inclined manner, optimally about 45°, but in this case away from the stenter. Again this is attained by inclining the underside of the chamber, while the nozzle and chamber are respectively uniform and tapered in cross-section.

Air for this last curtain is drawn from the buffer zone between the two curtains through plenum chamber 33 and outlet conduit 40. For this purpose the chamber 33 also has a slot opening extending across its underside. Preferably in this case the chamber 33 is of uniform cross-section and the opening is inwardly tapered in cross-section from its ends towards the region of its conduit connection for uniformity of operation along the chamber. Although less pertinent to the case of gas collection under suction rather than blown curtain generation, this opening is defined by a projecting nozzle 43 of a form allowing adjustment of the taper to suit an individual installation.

It is to be noted that the means 30*a* in FIG. 1 should extend wholly across the port, although the means may of course be made up by the use of two or more modular units in end-to-end relation across the port.

It will be appreciated that air will be lost to atmosphere from the ends of the buffer zone in the absence of measures to the contrary, and it is preferred that this be avoided. For this last purpose the curtain applying means on the opposite sides of the fabric are suitably interconnected at their ends by an effective integration of the respective partition structures. This is shown in FIG. 2 where the relevant upper and lower means, respectively denoted 30*a* and 30*b*, have an end wall 44 bridging their corresponding ends.

Also shown in FIG. 2 is a device 45 of roller blind form whereby dummy fabric 21 extends between the end wall 44 and the adjacent chain-driven gripping mechanism 13 of the stenter. The device 45 variably interposes the dummy fabric between the means 30*a* and 30*b* to avoid curtain impingement when the process fabric 20 is of less than the maximum width for the stenter.

Operation of the means 30*a* will be as described above, as clarified in FIG. 1 by arrows indicating consequent air flow, to form a buffer zone 50 bounded by the curtains, the partition structure, and the process and dummy fabric. Thus the curtain from nozzle 41 largely balances the outflow which would otherwise emerge from the port during stenter operation and so this curtain is deflected into the buffer zone 50. At the same time, air is drawn at nozzle 43 from the buffer zone to form the curtain from nozzle 42, which curtain partially replenishes the buffer zone and partially escapes to atmosphere in exchange for continuing addition of air by way of the first curtain. This operation will normally be such that the pressure in the buffer zone is markedly less than atmospheric, to an extend greater than that by which the pressure at the slot is likely to exceed atmospheric. For this reason, variations in pressure along the slot have little deleterious effect because they are swamped by the total pressure difference across the first curtain.

It should also be mentioned that when no fabric is present, the operating pattern just described is sufficiently sustained largely to balance the potential outflow from the port by direct interaction between the means 30*a* and 30*b*, although in practice dummy fabric can be used at the longitudinal ends of that to be treated and so allow for operaitonal build-up and run-down. It is, in the case of no such dummy fabric, appropriate for this purpose that the two curtain applying means should be in substantially mutually reflected dispositions about the process fabric path from a geometrical point of view.

While it is possible for the above operating pattern to be sustained without adjustment in some circumstances, it is preferred to provide an automatic dynamically operable facility which varies the air curtain flow rate in response to the air temperature in the buffer zone relative to that in the stenter oven and that of the surrounding atmosphere, as proposed above, and FIG. 1 shows a suitable arrangement for this purpose.

The illustrated arrangement is generally denoted 60 and comprises three transducers 61, 62 and 63 for respective location in the buffer zone, oven and surrounding atmosphere, or equivalent positions, and serving to generate signals $T_1$, $T_2$ and $T_3$ representing the associated local temperatures. These signals are applied to a comparator 64 operable on the basis of a function giving rise to a single output suitably representing the relative level of the buffer zone temperature $T_1$ between the other two temperatures. One function appropriate to this purpose is $(T_1-T_3)/(T_2-T_3)$ but others are possible. In any event the comparator output is applied in turn to a servosystem 65 operable to vary the position of a damper 66 in one of the conduits through which the air curtains are generated. Variation of the damper position will, of course, vary the flow rate of the respective curtain and so vary the buffer zone, and this last variation will be controlled to maintain the buffer zone temperature at a level which is predetermined to represent a situation in which the potential outflow from the port is reasonably balanced.

It is considered adequate in practice to apply such a control only to the first air curtain nearer to the port, at conduit 38 as shown, with the fans each being of a fixed form.

While the invention has been described with more particular reference to application in relation to slot-form ports in stenters and the illustrated embodiment of one such application, variation is clearly possible in both more general and more detailed respects. It has, for example, been indicated earlier that the invention is more generally applicable to treatment chambers with ports which remain open during operaion, and such chambers can be other than stenters and they can have ports of non-slot-form suited to the use of annular curtain formations. In terms of more detailed variations, it has been mentioned that the control function can be of other forms and it will be evident that curtain variation can be effected by way of fan speed rather than a damper, for example.

I claim:

1. In a throughflow treatment process which comprises passing material in an effectively continuous manner through a gaseous treatment chamber by way of at least one open port, the control improvement of applying gas curtains across the path of the material to form externally adjacent said port a buffer zone between the chamber interior and the surrounding atmosphere, which zone acts generally to balance the gaseous outflow otherwise occurring through said port during operation, said buffer zone being formed by and between two curtains serially spaced respectively nearer to and further from said port, with said nearer curtain being formed with gas drawn from without said zone, and with said further curtain being formed with gas drawn from within said zone.

2. A process control according to claim 1 wherein said buffer zone is sustained in relation to changed treatment conditions by varying the gas flow rate of at least one of said curtains in response to the value of a parameter of said zone.

3. A process control according to claim 2 wherein said gas flow rate is varied in response to comparison of respective differences between two different pairs of concurrent values of said parameter in said zone, said chamber and the surrounding atmosphere.

4. A process control according to claim 2 wherein said parameter is temperature.

5. Throughflow treatment apparatus comprising a gaseous treatment chamber having at least one open port allowing continuous passage therethrough of material to be treated, a screen extending around said port and outwardly from said chamber to define a screened space having portions of nearest, intermediate and furthest location relative to said chamber, first and second fans, first conduit means having inlet and outlet portions respectively communicating said first fan with the atmosphere without said screen and said screened space nearest portion to generate in operation a first gas curtain directed transversely across the path of said material, and second conduit means having inlet and outlet portions respectively communicating said second fan with said screened space intermediate and furthest portions to generate in operation a second gas curtain directed transversely across the path of said material and a negative pressure gas zone between said gas curtains.

6. Apparatus according to claim 5 wherein said first and second conduit outlet portions include projecting nozzles inclined respectivley towards and away from said chamber.

7. Apparatus according to claim 6 wherein said nozzle inclinations are each about 45°.

8. Apparatus according to claim 5, wherein said first and second conduit outlet portions and said second conduit inlet portion, each comprise a respective plenum chamber having a slot form opening directly communicating with said screened space.

9. Apparatus according to claim 8 wherein said outlet portion plenum chambers are each of cross-sectional form which is tapered towards the longitudinal ends of the respective opening, and each such last-mentioned opening is of uniform cross-sectional form.

10. Apparatus according to claim 9 wherein said inlet portion plenum chamber is of uniform cross-sectional form longitudinally of the respective opening, and such last opening is of tapered cross-sectional form inwardly from its ends.

11. Apparatus according to claim 5 wherein said port is of slot form for passage of strip material therethrough, said fans and conduit means are provided as an assembly operable on one side of said port and associated strip path, and a similar assembly is provided on the other side of said port and path.

* * * * *